United States Patent [19]

Henderson

[11] Patent Number: 4,745,969

[45] Date of Patent: May 24, 1988

[54] IN-CASING HYDRAULIC JACK SYSTEM

[76] Inventor: Tom Henderson, 303 E. Kern St., Taft, Calif. 93268-0253

[21] Appl. No.: 30,613

[22] Filed: Mar. 27, 1987

[51] Int. Cl.[4] ..... E21B 43/00

[52] U.S. Cl. ..... 166/68.5; 166/109; 417/402

[58] Field of Search ..... 166/68, 68.5, 105, 107, 166/109, 369; 417/401, 402

[56] References Cited

U.S. PATENT DOCUMENTS

| | | | |
|---|---|---|---|
| 3,051,237 | 8/1962 | Liles Jr. et al. . | |
| 3,376,826 | 4/1968 | Crowe . | |
| 4,026,661 | 5/1977 | Roeder | 417/401 X |
| 4,296,678 | 10/1981 | Felder | 92/13.1 |
| 4,403,919 | 9/1983 | Stanton et al. | 417/53 |
| 4,414,808 | 11/1983 | Benson | 417/402 X |
| 4,637,459 | 1/1987 | Roussel | 166/72 |
| 4,664,186 | 5/1987 | Roeder | 166/68.5 |

FOREIGN PATENT DOCUMENTS

| | | | |
|---|---|---|---|
| 82/00859 | 3/1982 | World Int. Prop. O. | 166/68.5 |

*Primary Examiner*—Stephen J. Novosad

*Assistant Examiner*—William P. Neuder

*Attorney, Agent, or Firm*—Sixby, Friedman & Leedom

[57] ABSTRACT

A hydraulic jack system for operating well bottom pumping units via a sucker rod string and polish rod that comprises a jack unit that is designed for mounting by being suspended fully within a well casing with a seal being created between the periphery of the jack unit and the interior of the well casing. The jack unit has a hollow piston-cylinder unit through which a polish rod is able to be inserted and withdrawn, to the top of which a top end of the polish rod is attachable and to the bottom of which a top end of a well fluid delivery tube is connectable. The construction of the unit enables a polish rod or sucker rod to be inserted and withdrawn through the jack unit without requiring pulling of the unit, and because all of the mechanical components of the unit are fully housed within the well casing, the presence of installed jack units in adjacent wells in closely clustered well sites, as are used in urban and other high land cost areas, will not interfere with the ability of a pulling rig to obtain access to the well being serviced.

20 Claims, 1 Drawing Sheet

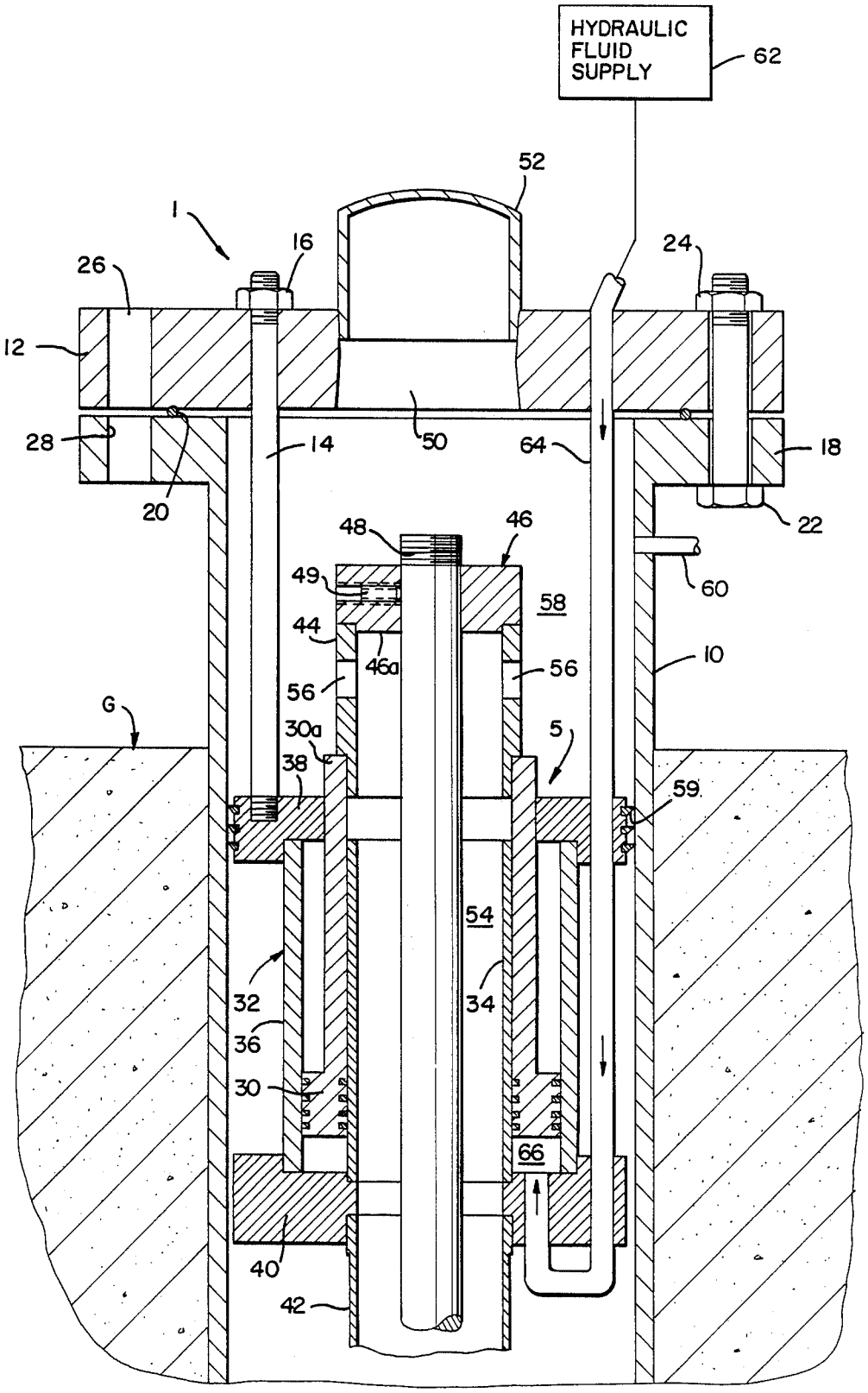
HYDRAULIC FLUID SUPPLY
62
52
1
16
24
26
12
28
14
50
64
18
20
22
48
46
49
58
60
44
46a
56
56
10
G
30a
5
38
59
54
32
34
36
30
66
40
42

IN-CASING HYDRAULIC JACK SYSTEM

BACKGROUND OF THE INVENTION

1. Field of the Invention

The present invention relates generally to well production equipment, and in particular to polish rod jack systems for oil well pumping units that utilize a sucker rod string to operate a bottom hole pump.

2. Description of the Prior Art

For wells used to bring liquids to the surface from subterranean liquid-bearing reservoirs whose pressure is insufficient to produce the formation fluids by natural means, a pumping system must be used to extract the liquids from the liquid-bearing reservoirs. In the case of pumping oil from wells, the type of pumping system most commonly used comprises a pump unit disposed at the bottom of the well, a drive unit or pump jack disposed adjacent the top of the well, and a string of sucker rods connecting the polish rod that is reciprocated by the drive unit or pump jack to a piston in the bottom hole pump unit. Furthermore, the drive unit of choice utilizes an oscillating horse head on a structural member referred to as a walking beam. U.S. Pat. Nos. 3,376,826; 3,051,237 and 4,296,678 are all examples of the use of a walking beam drive for a sucker string actuated pump.

Normally, oil well spacings are from about one well for every 40 acres, all the way down to about five acres per well when thick zones and shallow production is involved. Even with five acre spacing, sufficient room is available to set up a walking beam rig, and a rural environment is involved where aesthetics are not a significant factor. However, when oil is to be extracted at an urban location or a golf course or other area where land is expensive and/or aesthetics is a significant consideration, as many as 35 wells may be clustered in the middle of a five acre site, the wells being drilled straight down for approximately 500 feet, then whipstocked (angled) to bottom out in the production zone from 3,000 to 10,000 feet deep where the wells have about a 40 acre spacing. In such a situation, on the surface, a typical arrangement might have three rows of 11 wells each, with five feet spacing between wells and rows, making use of walking beam type pumping units impractical, even apart from environmental and appearance considerations which would be associated with the use of such a cluster of walking beam units.

As a result, an alternative pumping system must be utilized at cluster well sites. If it is still desired to utilize a sucker string-operated bottom hole pump, then the most commonly utilized mechanical alternative to the walking beam system is the "Phoenix" hydraulic pumping system of White-Hopkins, Inc., Chester, Okla., and an illustration of an equivalent type of unit can be found in U.S. Pat. No. 4,637,459. Such hydraulic pumping systems utilize a vertically oriented piston and cylinder unit to hydaulically lift the polish rod and sucker rod string, instead of an osciallating walking beam. Piston and cylinder units also have the advantage over a walking beam type pump in that they require less power to operate and can be more closely spaced together; however, they possess significant shortcomings from both an aesthetic and practical standpoint also. The most notable of these shortcomings are associated with the fact that a hydaulic jack lift system will project vertically anywhere from ten to 40 feet above ground, depending upon the stroke requirement. That is, a cluster of such towers may be as unattractive as walking beam units. Moreover, because sucker rods have to be periodically replaced, such as due to breakage, and since it is necessary to pull the polish rod in order to make stroke adjustments, a problem exists when the rod pulling rig must be brought in. In particular, rod pulling rigs are truck mounted and are, typically, at least eight feet across and 30 feet long, so that as many as from eight to ten of the surrounding wells must be shut down and their jack units removed in order for the pulling rig to gain access to the well whose rods are to be pulled. This need to inactivate a number of otherwise fully operational wells dramatically increases the costs associated with using such hydraulic jack lift rod pumping systems.

In view of the above deficiencies in hydraulic jack rod pumping systems, most cluster well installations utilize bottom hole pumps which are hydraulically driven from a surface power unit instead of a mechanical or hydraulic sucker rod type drive. One commonly used surface powered hydraulic down-hole pumping unit is the Kobe production unit produced by Kobe, Inc., Huntington Park, California. An example of another such down-hole hydraulic pumping system can be found illustrated in U.S. Pat. No. 4,403,919.

However, hydraulically driven systems pose their own disadvantages. Firstly, to hydraulic drive a bottom hole pump that may be 10,000 feet below the surface of the earth requires the use of high pressure pumps (having pressure ratings as high as 50,000 psi), as well as high pressure tubing for delivering the hydraulic fluid from the surface power unit to the down-pump and another string of tubing to return the hydraulic fluid back to the surface power unit (a return string is sometimes eliminated and the hydraulic fluid mixed with and returned with the production oil via the oil delivery tubing, but such requires the additional provision of a surface separation unit for separating the hydraulic fluid and production oil). Since, in some instances, it is desired to lift fluids from two or more subterranean formations by means of separate flow tubing strings in a common bore hole, the presence of such additional hydraulic fluid lines in addition to the necessary production oil delivery tubing poses problems in terms of the available space within the well casing.

Besides physical considerations, the cost of the equipment used to hydraulically drive a bottom hole pump is approximately twice that of mechanically driven downhole pumping arrangements. However, perhaps the most costly and disadvantageous factor in using a bottom hole pump taht is hydraulically driven from a surface unit is that such systems lead to as much as a 50% increase in the malfunction rate of the bottom hole pump due to particles (scale) in the hydraulic lines being carried by the hydraulic fluid being transported downhole to the pump, where they entering into the pump and prevent it from properly operating to an extent requiring the pump to be pulled for servicing. In this regard, it is also very significant that pump pulling operations for hydraulically driven bottom hole pumps involve the well being shut down for about four days, in comparison to an approximate six hour shutdown time when a mechanically driven bottom hole pumps malfunctions and must be pulled for servicing.

In view of the foregoing, it can be seen that there is a real need for a means for driving a bottom hole pump via a sucker rod string and polish rod which can be fully received within a well casing, so that the disadvantages of the above-mentioned types of pumping systems can be avoided wihtout creating other and at least equally disadvantageous conditions.

SUMMARY OF THE IVENTION

A primary object of the present invention is to provide a hydraulic/mechanical system for pumping oil wells that has a surface unit that can be hung inside of the well casing, so that there are no mechanical working parts outside of the well casing, except for surface pipeline connections, thereby preventing adjacent wells from blocking access to a well requiring pulling despite clustering of the wells.

Another object of the invention is to provide a hydraulic jack pumping system which will enable pulling of the polish and sucker rods to be accomplished without removing the jack unit from the well casing.

It is still another object of the present invention to provide a pumping system having a means for varying the stroke of an oil well subsurface pump by which adjustments can be simply and easily carried out by a manner comparable to that achieved by the pump stroke extender of my copending U.S. patent application Ser. No. 649,992, filed Sept. 13, 1984, which will issue as a U.S. Patent on Mar. 31, 1987, without having to pull the jack unit or to take other actions which would interrupt well production.

These and other objects are achieved in accordance with a preferred embodiment of the present invention via the provision of an in-casing hydraulic jack system for operating well bottom pumping units via a sucker rod string and polish rod that comprises a jack unit, having a hydraulic cylinder and a piston positioned for reciprocation within the hydraulic cylinder, mounting means for suspending the jack unit fully within a well casing, sealing means for producing a seal between the jack unit and the interior of the well casing, connecting means for connecting the jack unit to a top end of a well fluid delivery tubing, attachment means for attaching a top end of a polish rod to the piston of the jack unit so as to be displaceable in conjunction therewith, access means for enabling insertion and removal of the polish rod while the jack unit is suspended in the well casing, hydraulic fluid supply means for producing reciprocation of the piston within the cylinder so as to produce an upward stroking of the polish rod, and discharge means for enabling well fluid delivered by the well fluid delivery tubing during the upward stroking of the polish rod to bypass the sealing means so as to be discharged from the well casing during a downward return movement of the polish rod. More particularly, the jack unit of the preferred embodiment utilizes an annular piston and annular hydrualic cylinder through which the polish rod can extend to the attaching means therefor that is disposed centally at a top side of the jack unit, so that the polish rod and sucker rods can be inserted and withdrawn through the jack unit without requiring pulling thereof. Still further, the jack unit has a well fluid receiving chamber that increases and decreases in volume in conjunction with reciprocation of the piston within the cylinder of the jack unit so as to discharge fluids received during upward stroking of the polish rod during downward return movement thereof.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

The sole FIGURE of the drawings is a cross-sectional view of the top end of a well casing having an in-casing hydraulic jack system, in accordance with the present invention, disposed therein.

DETAILED DESCRIPTION OF THE PREFERRED EMBODIMENT

With reference to the sole FIGURE of the drawings, the in-casing hydraulic jack system according to the present invention is shown designated generally by the reference numberal 1. This hydraulic jack system 1 comprises a jack unit 5 that is disposed completely within a well casing 10, only the top end portion of which is shown in the vicinity where it emerges from the well bore hole in the ground G. The jack unit 5 is suspended within the well casing 10 (from 20 to 40 feet below the surface of the ground, depending upon the required stroke, the illustrated position near the surface of the ground being solely for illustration purposes) from a cover plate 12 by three suspension bolts 14 (only one which is shown) via a fastening nut 16. The cover plate 12 is sealed relative to a top flange of the well casing 18 via an interposed API seal ring 20 and is clamped therto by a plurality of bolts and nuts 22, 24 (only one of which is shown) that extend through the aligned openings 26, 28 of the cover plate and top flange, respectively.

The jack unit 5 is comprised of an annular piston 30 that is positioned for reciprocation within a hydraulic cylinder 32. The hydraulic cylinder 32 is comprised of a cylindrical inner wall 34, a cylindrical outer wall 36, a top flange plate 38, and a bottom flange plate 40. The bottom flange plate 40 has a threaded recess at an underside thereof into which the top end of a well fluid delivery tubing 42 is threadingly engaged. In this regard, it is noted that the well tubing 42 is connected to the bottom flange plate 40 of the jack unit 42 prior to the jack unit 5 being hung within the well casing 10, the top end of the well tubing being clamped in a position above casing flange 18, the jack unit then being screwed thereon and lowered with the delivery tubing 42 down into the casing 10.

While the lower end of inner and outer cylinder walls 34, 36 are threaded into respective threaded recesses in the top surface of bottom flange plate 40, only the upper end of outer cylinder wall 32 is threadingly engaged into a recess in the lower side of upper flange plate 38. In this way, by providing a centrally disposed through hole of a diameter slightly larger than the outer diameter of the annular piston rod **30*a* of the annular piston 30, the piston rod 30*a* is able to extend upwardly out of the cylinder, even in its lowered position. Attached to the upper end of piston rod 30*a* (such as by a threaded interconnection) is a cylindrical spacer 44**.

A rod clamp 46 is attached onto the upper end of a polish rod 48 (forming the end of a sucker rod string extending down to a mechanically actuated bottom hole pump). After rod clamp 46 has been threaded onto polish rod 48, a set screw 49 is tightened into engagement with the polish rod 48 to prevent loosening of the rod clamp 46 as a result of vibrations and the like occurring during pumping operation. Additionally, it is noted that the rod clamp 46 has a peripherally bevelled projection **46*a* which seats in the open upper end of the spacer 44 for providing a centering of the sucker rod within the jack unit. Futhermore, this nesting of the projection 46***a* within the spacer 44, under the weight of the polish rod and sucker rod string, provides a sufficient means for attaching the polish rod to the piston of the jack unit so as to be displaceable in conjuction therewith. It should also be appreciated that the rod clamp 46 can provide a means for very finely adjusting the position of the polish rod relative to the piston 30 (by increasing or decreasing the extent to which it is threaded onto the end of the polish rod) so as to thereby finely adjust the extent of its stroke in order to adjust the maximum stroke producible with a given polish rod 48.

In order to insert or remove the polish rod or sucker rod string, or to adjust the position of the rod clamp 46, a sufficient threaded length of the top of the polish rod 48 is always left projecting above the rod clamp 46 to permit a conventional rod pulling rig to be attached to the end of the polish rod. Futhermore, since the rod clamp 46 is the sole means of attachment of the polish rod to the jack unit 5 and it merely rests upon the spacer 44, by the provision of an aperture 50 in the cover plate 12, that has a greater diameter than the outer diameter of the rod clamp 46, the polish rod with the attached rod clamp, as well as an attached sucker rod string, can be passed through the cover plate 12 and jack unit 5. Thus, an installation or pulling operation can be performed while the jack unit 5 is suspended within the well casing 10, i.e., without having to pull the jack system 1. The aperture 50 in the cover plate 12 can be closed by any suitable closure means, such as the plug-like closure cap 52 shown in the illustrated embodiment.

For producing displacement of the piston 30 within the cylinder 32, a hydraulic fluid supply means 62 is connected via a hydraulic fluid line 64 to a pressurization chamber 66 within the hydraulic cylinder 32 that is situated at the underside of piston 30. The hydraulic fluid supply means may be of conventional design including a hydraulic pump that is driven by a motor, a reservoir of hydraulic fluid, and valve means for controlling the timing and quantity of fluid from the supply means to the jack unit 5 and from the jack unit 5 back to the reservoir, for example. Furthermore, it is contemplated that only one hydraulic supply means, controlled for example by a central computer program, could service a plurality of hydraulic jack systems 1.

Hydraulic fluid flowing into pressurization chamber 66 from the line 64 will drive the piston 30 upwardly to produce an upward stroking of the polish rod 48 and thereby cause the down-hole pump to force fluid from the subterranean formation up the well fluid delivery tubing 42 into the well fluid receiving chamber 54 formed within the hollow interior of the cylinder 32 and piston 30 of the jack unit 5. Again, it is noted that the jack unit 5 would not be normally positioned at the top of the well casing as illustrated, but rather would be situated 20 to 40 feet down in well casing 10, depending upon the required stroke length. It will be appreciated that, as piston 30 is displaced upwardly, the volume of the well fluid receiving chamber 54 will increase in conjunction with upward movement of piston 30, since it is formed in part by the moving interior surfaces of the upper end of piston rod 30*a* and spacer 44, but despite this increased volume, receiving chamber 54 will remain filled with oil (after an initial start-up period of operation) due to the entry of the fluid being forced up tubing 42.

At the same time as the upward movement of piston 30 is increasing the volume receiving chamber 54, together with spacer 44 and rod clamp 46, it is decreasing the volume of a casing interior space 58 that is situated above the jack units. Since, after the noted initial start-up period, interior space 58 is already full of oil, a discharge pressure of approximately 50 psi is created that forces the oil within the interior space 58 of casing 10 out through outflow line 60. In this regard, it is noted that, to prevent the oil in casing interior space 58 from flowing back down well casing 10 around the periphery of jack unit 5, sealing means 59 are provided on the periphery of the upper flange plate 38 of the cylinder 32 of producing a seal between the jack unit 5 and the interior of the well casing 10. The sealing means 59 can be, as illustrated, a plurality of circumferentially extending seal elements having a wedge-shaped lip that can flex upwardly during insertion of the jack unit 5, but will press against the casing wall under the effect of pressure applied from above.

At this point, the hydraulic fluid within pressurization chamber 66 is allowed to drain back out via the hydraulic line 64 so that the piston 30 is returned to its lowered position under the effect of the weight of the polish rod 48 and the sucker rod string secured to the lower end thereof. During this downward movement of the piston 30 and polish rod 48, the volume of the well fluid receiving chamber 54 is reduced. As a result of the enlarged well fluid receiving chamber 54 being completely full with fluid received via the delivery tubing 42 and because of the fact that a check valve (forming a standard part of conventional down-hole pumps) will prevent oil within the chamber 54 from going back down the delivery tubing 42, the fluid within the receiving chamber 54 is pressurized and forced out of the receiving chamber via discharge apertures 56 that are formed in the spacer 44 and into the casing interior space 58 that is located above the jack unit 5. Thus, as interior space 58 is returned to its original size during the piston downstroke, it is refilled with oil from chamber 54. It is also noted that, while not shown, a suitable number of gas vents (not shown) may also be provided in the cover plate 12 for venting of casing gases.

While a single hydraulic fluid line 64 has been shown for delivering hydraulic fluid to the chamber 66, it should be appreciated that as many as three such lines may be necessary and their size will vary depending upon space constraints of the casing and the pressures required to displace the piston 30. That is, in larger well casings, a jack unit with a larger piston 30 can be utilized, thereby requiring a lower hydraulic pressure for displacing the piston 30 to lift the polish rod and sucker rod string. On the other hand, in smaller casings or in situations where the jack unit comprises plural piston-cylinder units for independently stroking two or more sucker rod strings situated within the same well casing, higher pressures may be necessary to drive the resultingly smaller pistons. Therefore, the required hydraulic pressures for the fluid to be delivered to cylinder chamber 66 may vary from as low as 500 psi to as high as 3,000 psi since the diameter of the line 64 will impose constraints upon the delivery of the hydraulic fluid, it can be appreciated why, in some instances, more than a single hydraulic line 64 may be required.

It should also be recognized that, in addition to the fine-tuned adjustment of the stroke length of the polish rod 48 achievable by adjustment of the position of the rod clamp 46 thereon, variations in the stroke length can be produced simply by utilizing the hydraulic fluid supply means 62 to increase or decrease the extent of the reciprocatory movement of the piston 30 within the cylinder 32, thereby enabling the downhole pump output to be increased or decreased, or to compensate for stretching of the rods connected between the polish rod and the pump piston at the bottom of the well without having to pull the unit. Likewise, the stroke rate of the piston 30 may also be controlled by the hydraulic fluid supply means to vary the output of the down-hole pump or simply to match the jack unit reciprocation rate to the optimum pumping rate of the particular pump in use at the bottom of the well, again by means which would not interfere with well production.

In summary, it can be seen that the in-casing hydraulic jack system in accordance with the present invention achieves all of the initially mentioned objects, and more. In clustered well sites, the need to pull a polish rod or sucker rod from one well need not cause interruptions in production from adjoining wells since the mechanical components of the system are all disposed within the well casing, so that there are no structures which would interfere with a pulling rig being brought into the well site and set up. Furthermore, pulling and inserting of rods is simplifed and can be carried out in less time because the jack unit, itself, does not have to be removed from the well casing to perform such operations.

While I have shown and described various embodiments in accordance with the present invention, it is understood that the same is not limited thereto, but is susceptible of numerous chnages and modifications as known to those skilled in the art, and I, therefore, do not wish to be limited to the details shown and described herein, but intend to cover all such changes and modifications as are encompassed by the scope of the appended claims.

I claim:

1. An in-casing hydraulic jack system for operating well bottom pumping units via a sucker rod string and polish rod, comprising a jack unit having a hydraulic cylinder with top and bottom ends and a piston positioned for reciprocation within the hydraulic cylinder, mounting means connected to said jack unit for suspending said jack unit fully within a well casing, sealing means carried by the jack unit for producing a seal between said jack unit and the interior of said well casing, connecting means at the bottom end of the hydraulic cylinder for connecting said jack unit to a top end of a well fluid delivery tubing, attaching means for attaching a top end of a polish rod to said piston of the jack unit so as to be displaceable in conjuction therewith, access means disposed above said jack unit for enabling insertion and removal of the polish rod while said jack unit is suspended in the well casing, hydraulic fluid supply means connected to said hydraulic cylinder for producing reciprocation of said piston within said cylinder by delivery of hydraulic fluid to the hydraulic cylinder in a manner so as to produce an upward stroking of said polish rod, and discharge means in said jack unit for enabling well fluid delivered by said well fluid delivery tubing to bypass said sealing means so as to be discharged from said well casing at a location above said seal means.

2. An in-casing hydraulic jack system according to claim 1, wherein said piston and hydraulic cylinder are annular and said attaching means is centrally disposed with respect thereto at a top side of said jack unit.

3. An in-casing hydraulic jack system according to claim 2, wherein said connecting means is disposed at a bottom end of a well fluid receiving chamber in said jack unit and said discharge means comprises aperture means for communicating said receiving chamber with the interior of the well casing above said top side of the jack unit.

4. An in-casing hydraulic jack system according to claim 3, wherein said well fluid receiving chamber is defined by movable and fixed wall surfaces, said movable wall surfaces being displaceable relative to said fixed wall surfaces so as to increase and decrease the volume of said well fluid receiving chamber in conjunction with reciprocation of said piston within said cylinder.

5. An in-casing hydrualic jack system according to claim 4, wherein said sealing means comprises a circumferential casing seal on a peripheral flange of said jack unit.

6. An in-casing hydraulic jack system according to claim 5, wherein said mounting means comprises a cover plate with means for sealing attachment thereof upon a top flange of the well casing and a plurality of bolts extending downwardly from said cover plate to said jack unit.

7. An in-casing hydraulic jack system according to claim 6, wherein said access means comprises a central opening in said cover plate and removable closure means therefor.

8. An in-casing hydraulic jack system according to claim 4, wherin said mounting means comprises a cover plate with means for sealing attachment thereof upon a top flange of the well casing and a plurality of bolts extending downwardly from said cover plate to said jack unit.

9. An in-casing hydraulic jack system according to claim 8, wherein said access means comprises a central opening in said cover plate and removable closure means therefor.

10. An in-casing hydraulic jack system according to claim 1, wherein said sealing means comprises a circumferential casing seal on a peripheral flange of said jack unit.

11. An in-casing hydraulic jack system according to claim 1, wherein said mounting means comprises a cover plate with means for sealing attachment thereof upon a top flange of the well casing and a plurality of bolts extending downwardly from said cover plate to said jack unit.

12. An in-casing hydraulic jack system according to claim 11, wherein said access means comprises a central opening in said cover plate and removable closure means therefor.

13. An in-casing hydraulic jack system according to claim 2, wherein said hydraulic fluid supply means delivers hydraulic fluid to an underside of the piston to raise it relative to the cylinder and said piston is returnable under the action of the weight of the polish rod and sucker rod string.

14. In in-casing hydraulic jack system according to claim 13, wherein said piston projects upwardly from said cylinder into the interior of said well casing in a manner decreasing the volume of a portion of the interior of said well casing that is located above said jack unit during said upward stroking of the polish rod so as to act as a means for forcing fluid within said portion to flow out of the well casing.

15. An in-casing hydraulic jack system according to claim 14, wherein said well fluid receiving chamber is defined by movable and fixed wall surfaces, said movable wall surfaces being displaceable relative to said fixed wall surfaces so as to increase and decrease the volume of said well fluid receiving chamber in conjunction with reciprocation of said piston within said cylinder.

16. An in-casing hydraulic jack system according to claim 15, wherein said connecting means is disposed at a bottom end of a well fluid receiving chamber in said jack unit and said discharge means comprises aperture means for communicating said receivng chamber with the interior of the well casing above said top side of the jack unit.

17. An in-casing hydraulic jack system according to claim 1, wherein said hydraulic fluid supply means delivers hydraulic fluid to an underside of the piston to raise it relative to the cylinder and said piston is returnable under the action of the weight of the polish rod and sucker rod string.

18. An in-casing hydraulic jack system according to claim 17, wherein said piston projects upwardly from said cylinder into the interior of said well casing in a manner decreasing the volume of a portion of the interior of said well casing that is located above said jack unit during said upward stroking of the polish rod so as to act as a means for forcing fluid within said portion of flow out of the well casing.

19. An in-casing hydraulic jack system according to claim 18, wherein said well fluid receiving chamber is defined by movable and fixed wall surfaces, said movable wall surfaces being displaceable relative to said fixed wall surfaces so as to increase and decrease the volume of said well fluid receiving chamber in conjunction with reciprocation of said piston within said cylinder.

20. an in-casing hydraulic jack system according to claim 19, wherein said connecting means is disposed at a bottom end of a well fluid receiving chamber in said jack unit and said discharge means comprises aperture means for communicating said receiving chamber with the interior of the well casing above said top side of the jack unit, fluid within said receiving chamber being discharged through said aperture means into the interior portion of the well casing above the jack unit during return movement of the piston.

* * * * *